US005099863A

United States Patent [19]

Coleman

[11] Patent Number: 5,099,863

[45] Date of Patent: Mar. 31, 1992

[54] APPARATUS FOR SEPARATING THRESHED LEAF TOBACCO

[75] Inventor: G. A. John Coleman, Richmond, Va.

[73] Assignee: Universal Leaf Tobacco Co., Inc., Richmond, Va.

[21] Appl. No.: 591,054

[22] Filed: Oct. 1, 1990

Related U.S. Application Data

[63] Continuation-in-part of Ser. No. 88,390, Aug. 24, 1987, abandoned, which is a continuation-in-part of Ser. No. 304,267, Jan. 2, 1989, abandoned.

[51] Int. Cl.[5] ..... A24B 5/10

[52] U.S. Cl. ..... 131/312; 209/136; 209/138

[58] Field of Search ..... 131/312; 209/136, 138

[56] References Cited

U.S. PATENT DOCUMENTS 2,697,439 12/1954 Davis ..... 131/312
3,362,414 1/1968 Wochnowski ..... 131/312
4,465,194 8/1984 Coleman .

*Primary Examiner*—Vincent Millin
*Assistant Examiner*—Lynne A. Reichard
*Attorney, Agent, or Firm*—Cushman, Darby & Cushman

[57] ABSTRACT

A separation device for separating threshed leaf tobacco into (1) lighter particles such as lamina containing little or no stem and (2) heavier particles such as lamina with attached stems or naked stems. The device includes a housing defining a separation chamber. A fan circulation system having an improved variable flow plural flow path arrangement establishes a generally upward air flow through the separation chamber. A tobacco supply inlet is disposed at an inlet side of the separation chamber for receiving a supply of threshed leaf tobacco downwardly therethrough and a threshed leaf tobacco projecting winnower is disposed below the tobacco supply inlet for projecting the supply so that (1) the lighter particles are generally carried upwardly by the air flow within the separation chamber and (2) the heavier particles move generally downwardly through the air flow. An improved system is provided for receiving and discharging the lighter particles carried upwardly by the air flow within the separation chamber. A heavy particle outlet on an outlet side of the separation chamber is provided for receiving heavy particles downwardly therethrough. The inlet and outlet are positioned and constructed such that the separation device can be mounted in side by side relation to a similar separation device having a similar inlet such that the heavier particles moving downwardly through the outlet of the separation device pass downwardly through the similar inlet of the similar separation device.

42 Claims, 4 Drawing Sheets

APPARATUS FOR SEPARATING THRESHED LEAF TOBACCO

This application is a continuation-in-part of my U.S. application Ser. No. 07/088,390, filed Aug. 24, 1987, entitled "Apparatus for Separating Threshed Leaf Tobacco" now abandoned and a continuation-in-part of my U.S. application Ser. No. 07/304,267, filed Jan. 2, 1989, entitled "Plural Stage Tobacco Separator" now abandoned.

The invention relates to apparatus for separating threshed leaf tobacco, and more particularly to apparatus of this type which will improve the separation characteristics while minimizing damage to the lamina particles.

The invention is particularly concerned with the separation of threshed tobacco leaves by air stream separation into (1) lighter particles such as lamina with little or no stem, and (2) heavier particles such as stem with or without attached lamina. Air flotation type separation apparatus is known, and basically includes a separation chamber having opposed sides and a closed fan system for establishing a generally upward flow of air within the chamber between the sides thereof. Successive particles from a supply of threshed leaf tobacco are projected from one side of the chamber across the chamber so that (1) lighter particles are carried upwardly by the airflow within the chamber, and (2) heavier particles move by gravity downwardly through the airflow within the chamber. A discharge system is provided in the upper portion of the chamber for receiving the upwardly carried lighter particles and discharging them from the chamber, and a separate discharge system is provided in the lower portion of the chamber for receiving the heavier particles moving downwardly by gravity and discharging the same from the chamber.

In my U.S. Pat. No. 4,465,193, there is disclosed an apparatus of this type in which means is provided for further handling and separating projected particles which travel entirely across the chamber and for effecting a final separation of lighter particles entrained with the particles received in the heavier particle discharge system. The lighter particles separated in the apparatus are frequently subsequently shredded into a form useful in cigarettes. An area of the apparatus where lighter particles are subject to damage is in the lighter particle discharge system.

The structure provided in the apparatus of my United States patent for receiving and discharging the lighter particles includes an enlarged centrifugal or tangential separator housing connected to a primary separation chamber and an adjacent secondary chamber by a relatively narrow duct. The separator housing has a power driven air lock in its lower portion and a central lateral air return communicating therewith. While the particular lighter particle receiving and discharging means functioned to accomplish the discharge of the lighter particles, there is always a need to provide a cost-effective improvement which will accomplish the discharge of the lighter particles with less damage.

It is an object of the present invention to fulfill the above-described need. In accordance with the principles of the present invention, this objective is obtained by providing an apparatus for separating lighter particles such as lamina containing little or no stem from threshed leaf tobacco which comprises a housing structure defining a separation chamber having opposite sides. A fan system is provided for establishing a generally upward air flow in the separation chamber between the opposite sides thereof. A threshed leaf tobacco projecting mechanism is provided in one side of the chamber for projecting threshed leaf tobacco across the generally upward air flow in the chamber so that (1) lighter particles are carried upwardly by the air flow within the chamber and (2) heavier particles move by gravity downwardly through the air flow within the chamber. A mechanism is provided for receiving the heavier particles moving downwardly through the air flow within the chamber and discharging the heavier particles therefrom. An improved mechanism is provided for receiving the lighter particles carried upwardly by the air flow within the chamber and discharging the lighter particles therefrom. The lighter particle receiving and discharging mechanism comprises an exit chamber adjacent the upper portion of the separation chamber, an endless foraminous conveyor having a lower operative flight extending across the upper portion of the separation chamber and into the exit chamber. The fan system is mounted so that the pressure side thereof is operable to establish the generally upward air flow within the separation chamber and the suction side thereof is operable to cause air in the upper portion of the separation chamber to move upwardly through the operative flight of the endless foraminous conveyor whereby the lighter particles moving upwardly within the separation chamber are biased thereby to be engaged on downwardly facing surfaces of the operative flight of the endless foraminous conveyor. The endless foraminous conveyor is driven in a direction to cause the lighter particles engaged on the downwardly facing surfaces of the operative flight thereof to be moved from the separation chamber into the exit chamber where the engaged lighter particles are no longer biased into conveyor flight engagement by upwardly flowing air and are moved downwardly from conveyor flight engagement for discharge from the exit chamber by gravity.

Preferably, a barrier system is provided for permitting movement of the operative flight of the endless foraminous conveyor with engaged lighter particles between the separation and exit chambers while providing a barrier to the flow of air therebetween. The barrier system comprises a paddle wheel winnower mounted between the separation and exit chambers in a position below the operative flight of the endless foraminous conveyor. The paddle wheel winnower is rotated so that an upper periphery thereof moves generally at the speed and in the direction of the operative flight of the endless foraminous conveyor. Preferably, the exit chamber is provided with a power-operated paddle wheel winnower operatively associated with the leading end of the portion of the operative flight therein for (1) positively removing particles remaining in engaged relation with the downwardly facing surfaces thereof, and (2) moving the same downwardly.

With all of the apparatus of the type herein contemplated, it is often the case that the heavier particle fraction discharging from the apparatus contains lighter particles clumped therewith which did not get separated in the operation of the apparatus. Consequently, it is often the practice to set up an intervening power-operated system for delivering the heavier particle discharge from one apparatus to the inlet of a similar apparatus as the threshed leaf tobacco supply thereof. In this way, a better final separation can be achieved. However, due to the additional handling by the intervening power-operated system, it is achieved in a manner which tends to effect damage to the lamina. There is, therefore, a need to provide an apparatus of the type described capable of cooperating with a similar apparatus without the need to provide a lamina-damaging intervening power-operated system.

Accordingly, it is another object of the present invention to provide a single apparatus which will fulfill the above-described need. While it is preferred to use the above-described smaller particle receiving and discharging arrangement, the fulfillment of this objective can be accomplished utilizing any type of such arrangement. In accordance with the principles of the present invention, this objective is obtained by providing an apparatus for separating threshed leaf tobacco into (1) lighter particles such as lamina containing little or no stem and (2) heavier particles such as lamina with attached stems or naked stems which comprises a housing structure defining a separation chamber having horizontally spaced and opposed tobacco inlet and outlet sides and vertically spaced lower air inlet and upper air outlet ends. A fan system is provided for establishing a generally upward air flow from the lower air inlet end through the separation chamber and outwardly through the upper outlet end thereof. A tobacco supply inlet is disposed at the inlet side of the separation chamber for receiving a supply of threshed leaf tobacco downwardly therethrough. A threshed leaf tobacco projecting mechanism is provided below the tobacco supply inlet for receiving the supply of threshed leaf tobacco moving downwardly through the inlet and for projecting the supply of threshed leaf tobacco across the generally upward air flow within the separation chamber so that (1) the lighter particles are generally carried upwardly by the air flow within the separation chamber and (2) the heavier particles move generally downwardly through the air flow within the separation chamber. A lighter particle receiving and discharging system is provided for receiving and discharging the lighter particles carried upwardly by the air flow within the separation chamber and discharging the lighter particles therefrom. A heavy particle outlet is provided on the outlet side of the separation chamber for receiving heavy particles downwardly therethrough. A heavy particle contacting system is provided for directing heavier particles moving downwardly through the upward air flow into the outlet. The inlet and outlet are positioned and constructed such that the separation chamber can be mounted in side by side relation to a similar separation chamber having a similar inlet such that the heavier particles moving downwardly through the outlet of the separation chamber pass downwardly through the similar inlet of the similar separation chamber.

Preferably, the heavy particle contacting system is an endless foraminous conveyor through which the upward air flow passes. In conjunction with the use of an endless heavy particle foraminous conveyor through which the upward air flow passes, it has been found desirable in order to minimize clumping to provide for the direction of the upward air flow along a plurality of separate flow paths, the proportional amount of air in which can be varied. Here, again, the features of the present invention which are provided to deal with this problem have applicability to apparatus of the types herein contemplated even though such apparatus does not embody the features already described although such features are preferred.

Accordingly, it is still another object of the present invention to provide an apparatus for separating threshed leaf tobacco into (1) lighter particles such as lamina containing little or no stem and (2) heavier particles such as lamina with attached stems or naked stems which comprises a housing defining a separation chamber having horizontally spaced and opposed tobacco inlet and outlet sides and vertically spaced lower air inlet and upper air outlet ends. A fan system is provided for establishing a generally upward air flow from the lower air inlet end through the separation chamber and outwardly through the upper outlet end thereof. A threshed leaf tobacco projecting winnower is provided for receiving the supply of threshed leaf tobacco moving downwardly through the inlet and for projecting the supply of threshed leaf tobacco across the generally upward air flow within the separation chamber so that (1) the lighter particles are generally carried upwardly by the air flow within the separation chamber and (2) the heavier particles move generally downwardly through the air flow within the separation chamber. A suitable system is provided for receiving and discharging the lighter particles carried upwardly by the air flow within the separation chamber and discharging the lighter particles therefrom. An endless heavy particle discharging foraminous conveyor is provided within the lower air inlet end of the separation chamber having openings therein of a size to allow the upward air flow to pass upwardly therethrough while preventing heavier particles moving downwardly through the upward air flow from passing downwardly therethrough. A pressure side duct assembly is provided for communicating the pressure side of fan with the lower inlet end of the separation chamber which includes an upwardly diverging downstream duct section extending to the heavy particle conveyor and an upstream duct section extending from the pressure side of the fan and connected with the downstream duct section. An upstream portion of the main upstream duct section confines the full pressure side flow of air of the fan and duct divider walls are mounted within the downstream duct section having a downstream ending at the downstream end of the downstream duct section. The duct divider walls extend from the downstream ending thereof downwardly within the downstream duct section and into a downstream portion of the main upstream duct section to an upstream ending thereof so as to divide the air flowing thereby into a plurality of separate flow paths. Air vanes are provided immediately upstream of the upstream ending of the duct divider walls for varying the proportional amount of the full pressure side flow of air in the upstream portion of the main upstream duct section directed into the separate flow paths so as to establish a distribution of air flow upwardly from the downstream duct section which tends to reduce clumping of tobacco particles projected across the upward air flow to thereby facilitate the carrying upward of the lighter particles with the upward air flow and the downward movement of the heavier particles through the upward air flow.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
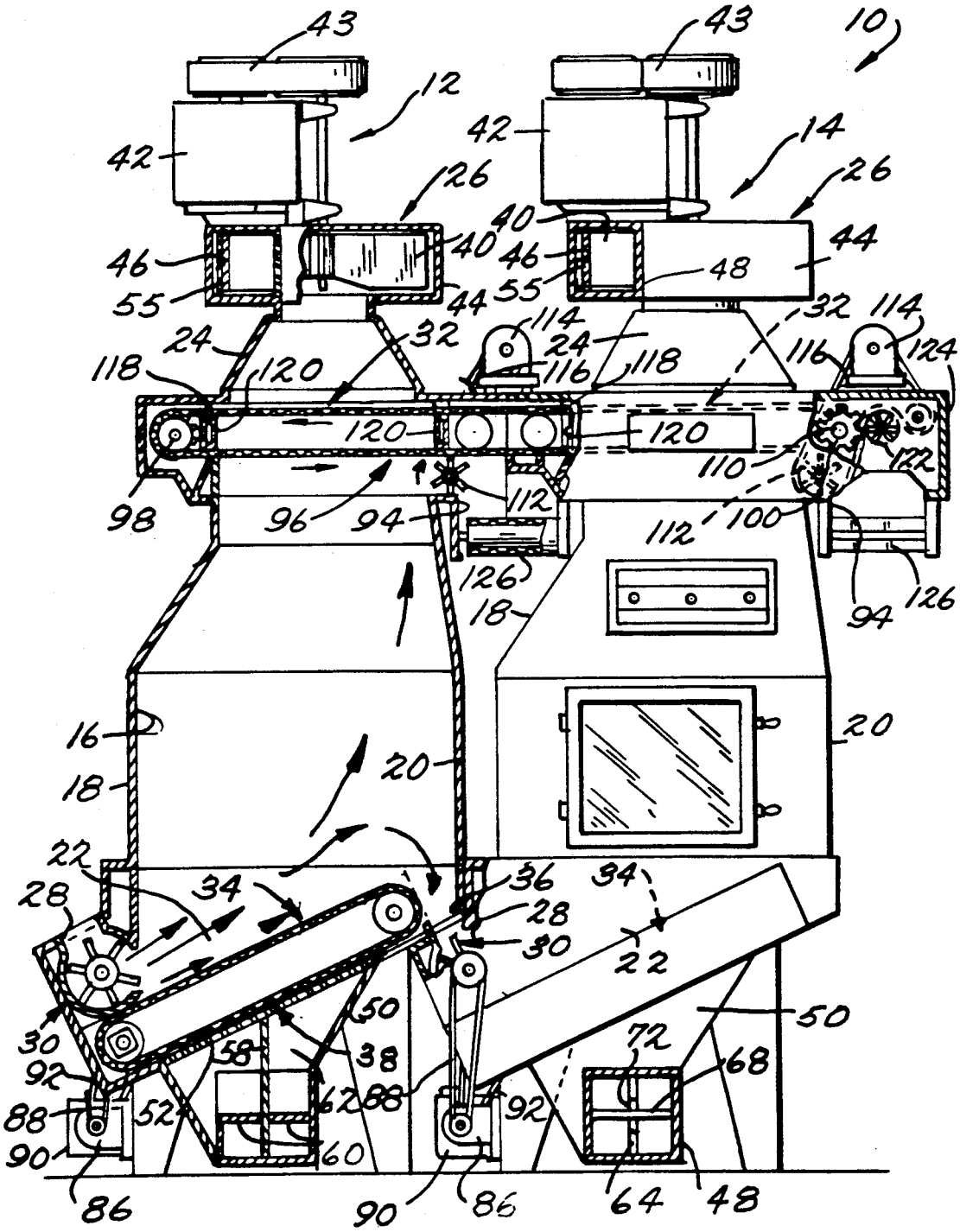
FIG. 1 is a front elevational view of an apparatus embodying the principles of the present invention with certain parts broken away for purposes of clear illustration.

Referring now more particularly to the drawings, there is shown therein an apparatus, generally indicated at 10, for separating threshed leaf tobacco into (1) lighter particles such as lamina containing little or no stem, and (2) heavier particles such as lamina with attached stem or naked stems. The apparatus 10 includes two separation devices, generally indicated at 12 and 14, which are of similar construction. Each separation device 12 and 14 is capable of operating alone or in cooperating side-by-side relation with a similar device. Thus, while two separation devices 12 and 14 are shown, it will be understood that the invention contemplates that the apparatus 10 can include more than two similar separation devices.

Set forth below is a description of the structure of the separation device 12 and its mode of operation (1) alone and (2) in conjunction with the similar separation device 14. It will be understood that, since the separation devices 12 and 14 are similar, a description of separation device 12 will be sufficient to provide an understanding of the construction and operation of the separation device 14. Accordingly, the same reference numerals utilized in the description of separation device 12 will be applied to separation device 14.

As shown, the separation device 12 provides a housing structure defining a separation chamber 16 having a tobacco inlet side 18, an opposite tobacco outlet side 20, a lower air inlet end 22, and an upper air outlet end 24.

A variable plural path fan circulating system, generally indicated at 26, is mounted exteriorly of the separation chamber 16 with its suction side connected with the upper air outlet end 24 thereof and the pressure side connected with the lower air inlet end thereof. The fan system 26 is operable to establish a generally upward flow of air within the separation chamber 16.

Mounted in the tobacco inlet side 18 of the separation chamber 16 is an inlet 28 for receiving a supply of threshed leaf tobacco downwardly therethrough. The inlet 28 delivers the supply of threshed leaf tobacco downwardly into cooperating relation with a threshed leaf tobacco projecting mechanism, generally indicated at 30, operable to project the supply of threshed leaf tobacco from the tobacco inlet side 18 of the separation chamber 16 toward the opposite tobacco outlet side 20 thereof, so that (1) lighter particles are carried upwardly by the flow of air within the separation chamber 16, and (2) heavy particles move by gravity downwardly through the flow of air within the separation chamber 16.

A lighter particle receiving and discharging system, generally indicated at 32, is provided in the upper air outlet end 24 of the separation chamber 16 for receiving the lighter particles carried upwardly by the flow of air within the separation chamber and discharging the lighter particles therefrom. A heavier particle receiving and discharging system, generally indicated at 34, is provided in the lower air inlet end 22 of the separation chamber 16 for receiving the heavier particles moving by gravity downwardly with the upward air flow and discharging them from the separation chamber 16.

In accordance with the principles of the present invention, the discharging means of the system 34 is an outlet 36 formed in the outlet side 20 of the separation chamber 16 for receiving heavier particles downwardly therethrough. It will be noted that the lower end of the outlet 36 is at a vertical level slightly above the vertical level of the upper end of the inlet 28 so as to deliver the heavier particles downwardly from the outlet 36 directly into the inlet 28 of a similar device, such as the device 14. The heavier particle receiving and discharging system 34 also preferably includes an endless foraminous conveyor mechanism, generally indicated at 38, having openings of a size (1) to enable the upward air flow to pass therethrough and (2) to receive and prevent passage of heavier particles therethrough. The conveyor mechanism 38 is operable to deliver heavier particles received thereon downwardly into the outlet 36.

It will also be noted that the outlet 36 is disposed in a position to receive threshed leaf tobacco projected by the threshed leaf tobacco projecting system 30 which has not been (1) carried upwardly by the air flow in the separation chamber 16 and received as lighter particles by the lighter particle receiving and discharging system or (2) moved downwardly through the upward air flow in the separation chamber and received as heavier particles by the heavier particle conveyor mechanism 38.

The separation chamber 16 may be formed of any desirable construction. In the drawings, the separation chamber 16 is schematically illustrated to be formed of sheet metal. It will be understood that a rigid framework for retaining the sheet metal (not shown) normally would be provided. As shown, the separation chamber 16 is of generally rectangular configuration with the lower portion being somewhat enlarged, and the upper portion being generally of upwardly tapering design configuration which aids in separating the lighter particles by increasing the velocity of the upward air flow as it passes therethrough.

The fan circulating or airflow establishing system 26, as shown, includes a fan blade assembly 40, suitably journalled for rotational movement about a vertical axis within a housing of conventional fan configuration. The fan blade assembly 40 is driven by a suitable variable speed motor 42 through a suitable motion transmitting mechanism, such as a belt and pulley assembly 43. The fan housing includes an arcuate peripheral wall 44 which extends somewhat less than 360° so as to provide for a tangential discharge chute 46 which constitutes the pressure side of the fan blade assembly 40. The lower end of the suction side of the fan blade assembly 40 communicates directly with the upper end of the upper air outlet end 24 of the separation chamber 16, and a top wall of the fan section closes the upper end thereof.

Figure 3:
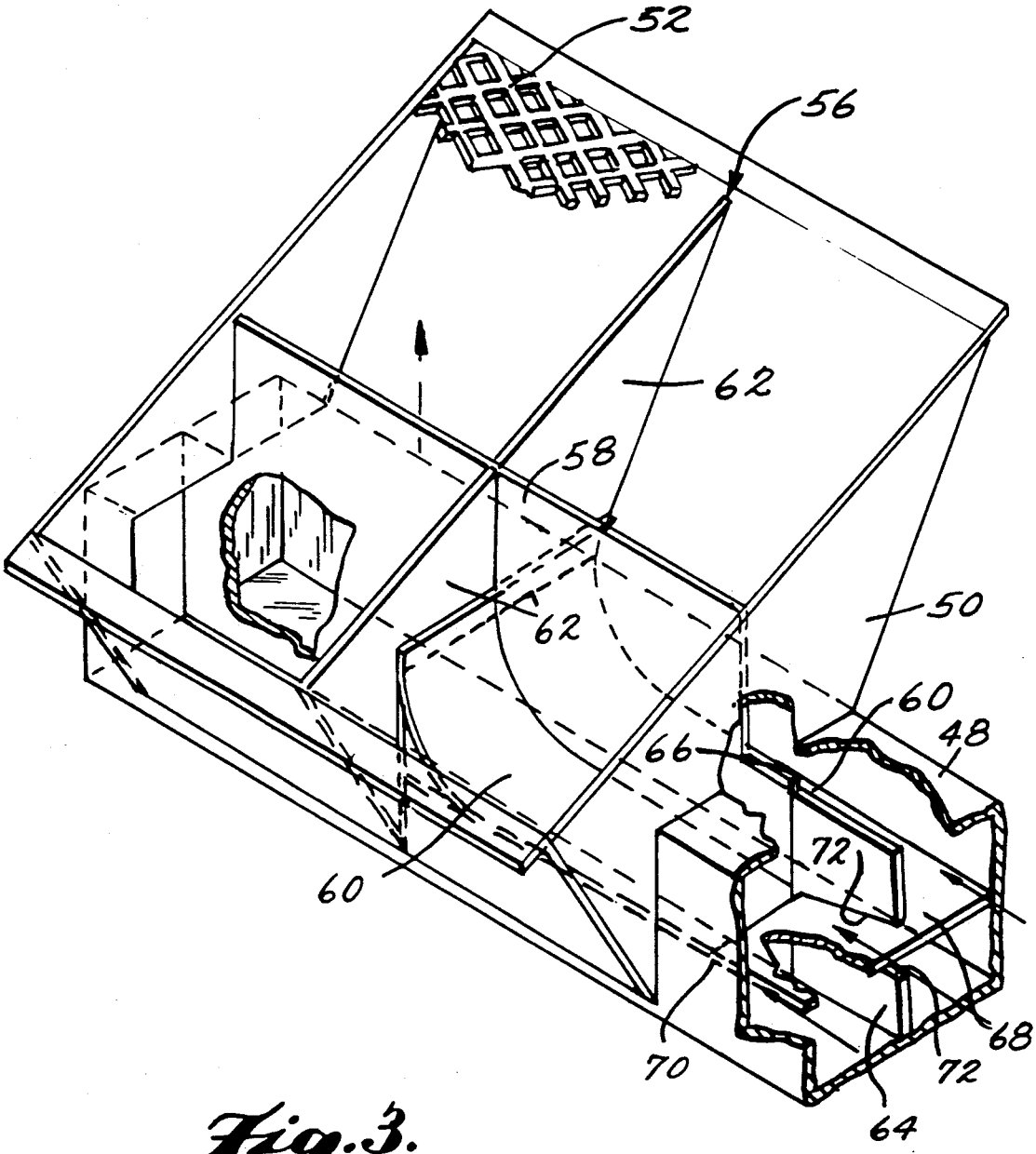
FIG. 3 is an isometric view illustrating the system for dividing the lower inlet end of each separation device into a plurality of separate flow paths and for varying the amount of air directed to each separate flow path, the view being shown with parts broken for purposes of clear illustration.

The tangential discharge 46 of the fan blade assembly 40 is connected with the upstream end of a generally vertically elongated C-shaped main pressure side duct section 48, the downstream horizontal end portion of which connects with the upstream end of a downstream outlet duct section 50 which has a downstream ending just below the endless heavier particle conveyor mechanism 38 and which discharges thereto through a suitable perforated or apertured diffusing plate or screen 52, such as shown in FIG. 3.

Figure 2:
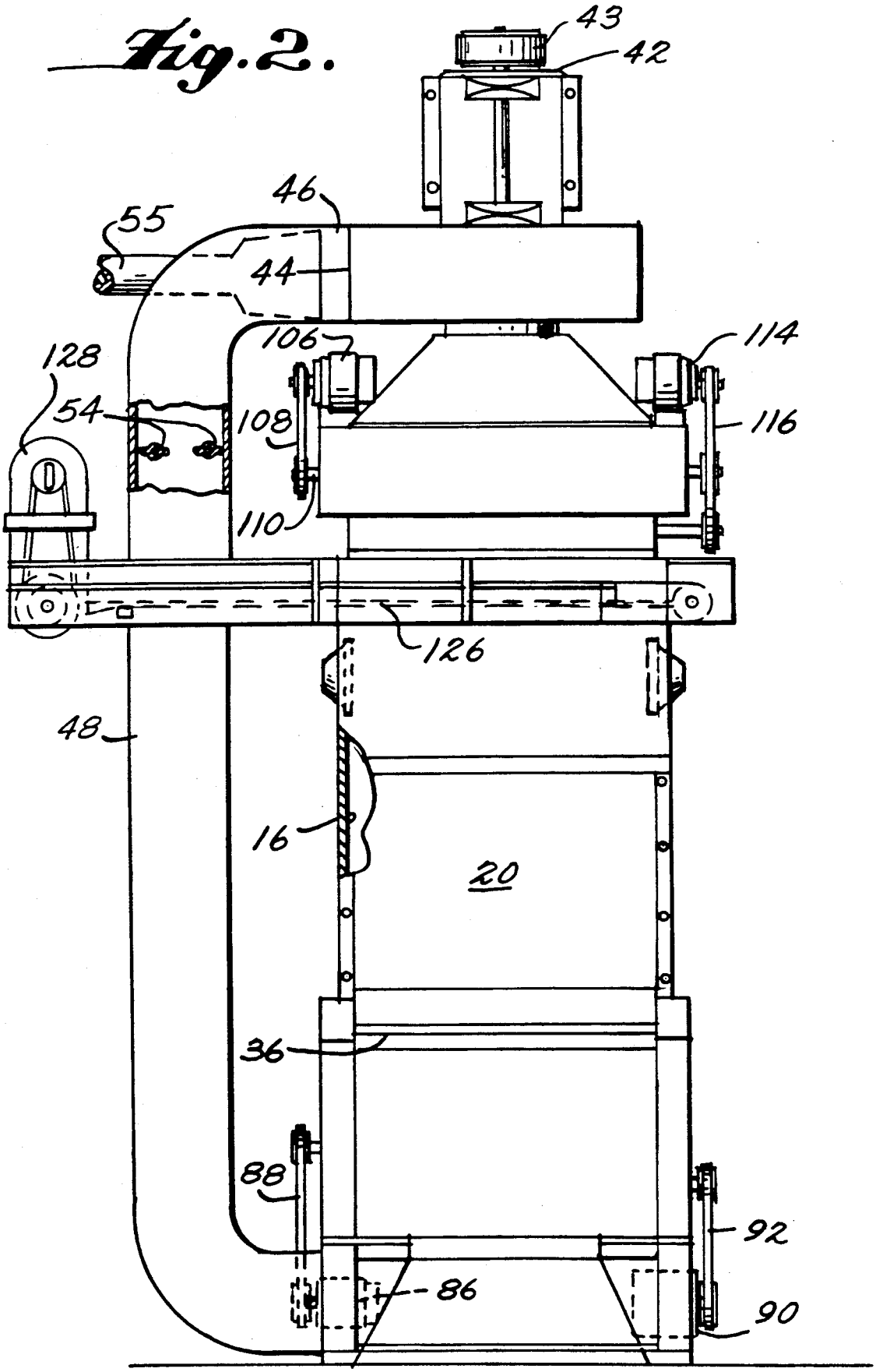
FIG. 2 is an elevational view of the apparatus taken from the outlet side thereof, with certain parts broken away for purposes of clear illustration.

As best shown in FIG. 2, the main pressure side duct section 48 includes adjustable dampers 54 which can be used for controlling the amount of flow in the duct section downstream thereof in lieu of the variable speed fan motor 42. Moreover, a bleed off duct section 55 is provided at the tangential discharge chute 46 so as to bleed off about 10% of the full capacity of the fan to maintain a negative pressure on the system and remove dust for product and environmental purposes. It will be understood that a manually controlled fresh air inlet (not shown) may be provided in the system 26 preferably on the suction side of the fan 40.

Referring now more particularly to FIG. 3, there is shown therein an adjustable air flow dividing system, generally indicated at 56. As shown, the system 56 includes a vertically extending divider wall 58 having an upstream end within the horizontal downstream end portion of the main duct section 48 and a downstream end which terminates just below the diffusing plate 52. The diffusing plate 52, like the conveyor 38, slopes upwardly from the inlet side 18 of the separation chamber 16 to the outlet 36 therein adjacent the outlet side 20. The outlet duct section 50 diverges upwardly in a direction toward the inlet and outlet sides of the separation chamber 16. The vertical divider wall 58 divides the full flow within the main duct section 48 into two divided paths one at the inlet side 18 of the separation chamber 16 and the other at the outlet side 20 thereof.

The system 56 also includes a pair of divider walls 60 on opposite sides of the vertical divider wall which divides each of the aforesaid two paths into two paths. The horizontal divider walls 60 extending horizontally from their upstream ends adjacent the upstream end of the vertical wall 58 and curve upwardly at the downstream ends into abutting relation to a pair of vertical divider walls 62. The divider walls 58, 60 and 62 thus serve to divide the full air flow within the main duct section 48 into four separate air flow paths which are in quadrant formation at the downstream end thereof at the diffusing plate 52.

The system 56 includes means at the upstream end of these four separate flow paths for varying the proportion of the full air flow within the main duct section 48 which is directed to the four separate paths. FIG. 3 illustrates the flow proportion varying means as including a vertical vane 64 pivoted, as at 66, adjacent the upstream end of the vertical divider wall 58 and a horizontal vane 68 pivoted, as at 70, adjacent the upstream end of the horizontal divider walls 60. In order to accommodate the horizontal vane 68, the vertical vane has an angular section 72 removed therefrom.

Figure 4:
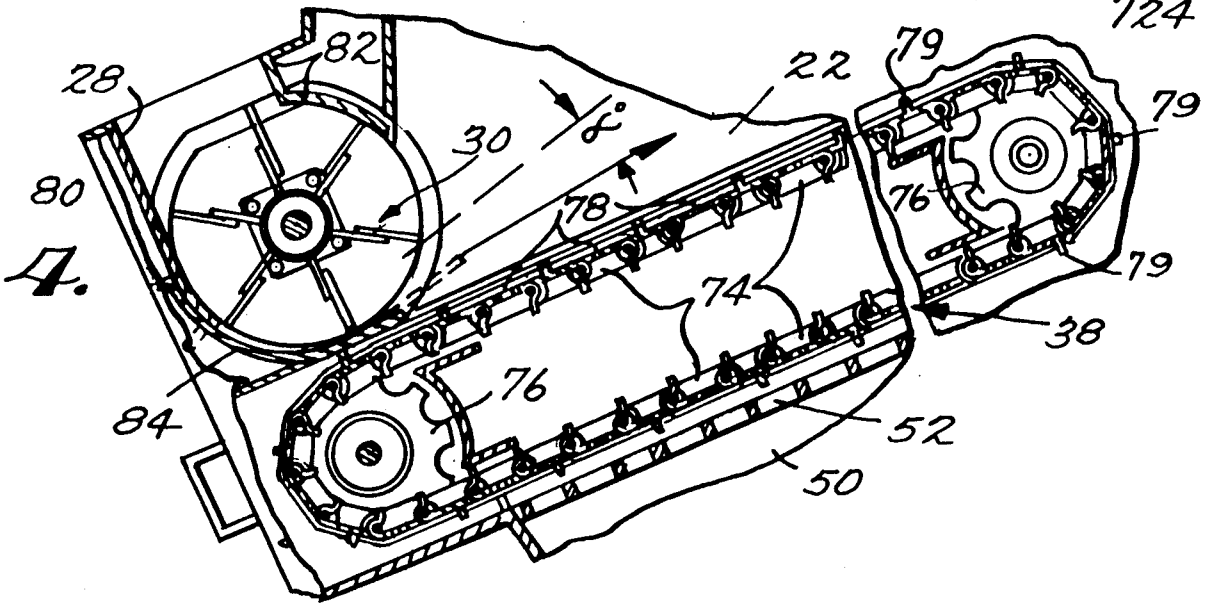
FIG. 4 is an enlarged fragmentary sectional view illustrating the inlet and adjustable tobacco projecting system of the present apparatus.

Referring now more particularly to FIG. 4, it will be noted that the heavier particle endless foraminous conveyor 38 which is illustrated schematically as an endless screen type conveyor in FIG. 1 preferably is an endless conveyor of the type which includes a pair of transversely spaced endless chains 74 each trained about a pair of sprocket wheels 76 and a plurality of perforated metal slats 78 pivotally interconnected, as by piano hinges, and extending transversely between the links of the chains. The perforations in the slats enable the flow of air upwardly therebetween, first through a lower return flight and then upwardly through an upper operative flight. The size of the perforations in the slats 78 is such that heavier particles moving downwardly within the upward air flow as it enters into the lower air inlet end 22 of the separation chamber 16 cannot pass therethrough. In this way, heavier particles received on the upper operative flight of the endless foraminous conveyor 38 will be carried thereon toward a discharge position above the outlet 36, as the endless conveyor passes over the outlet side sprocket wheel 76. Every second slat 78 has a metal cleat 79 on the outside to lift and carry the heavy particles which come into contact with the conveyor.

FIG. 4 also shows that the inlet 28 for the threshed leaf tobacco supply is defined by spaced walls 80 and 82. The wall 80 has its lower end portion curved to form part of a peripheral housing for the threshed leaf tobacco projecting mechanism which preferably is in the form of a paddle wheel type rotary winnower 30. An adjustable peripheral wall section 84 is disposed in cooperating relation with the curved portion of the wall 80 and includes a tangential discharge end which serves to determine the direction that the threshed leaf tobacco is projected from the inlet side 18 of the separation chamber toward the outlet side 20 thereof. The discharging wall section 84 is adjustable about the axis of rotation of the rotary winnower 30 through a limited angular range so as to adjust the angle of projection. Finally, it will be noted that wall 82 provides a fixed peripheral wall section for the winnower 30. The construction of the inlet 28 is therefore to direct the supply of threshed leaf tobacco received downwardly therein, downwardly into cooperating relation with the winnower 30.

As shown in FIGS. 1 and 2, the rotary winnower 30 is driven by a suitable variable speed motor 86 through a suitable motion transmitting mechanism such as belt and pulley assembly 88. A fixed speed motor 90 is also provided for driving the endless foraminous conveyor 38 through a suitable motion transmitting assembly, such as belt and pulley assembly 92.

Figure 5:
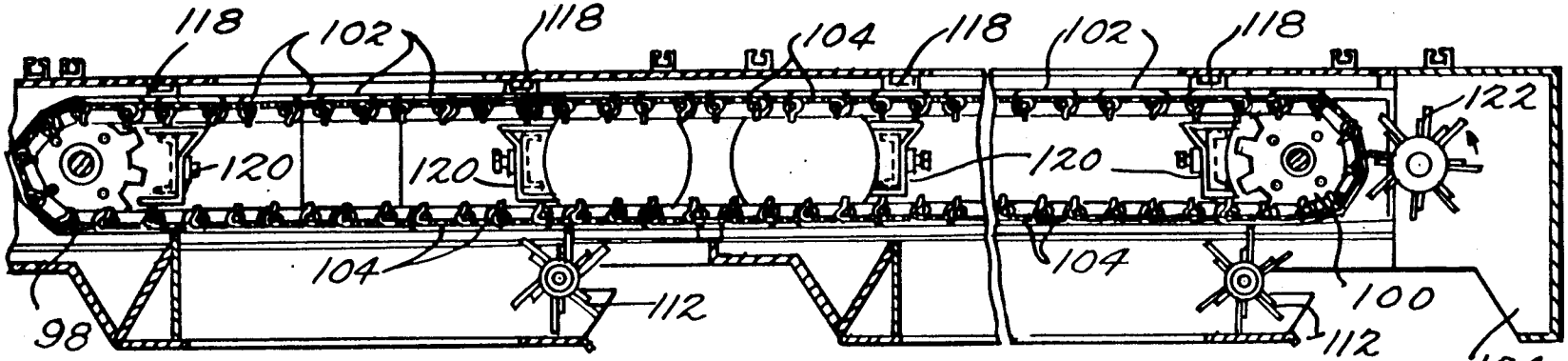
FIG. 5 is an enlarged fragmentary sectional view showing the lighter particle receiving and discharging mechanism of the apparatus of the present invention.

Referring now more particularly to FIGS. 1 and 5, the lighter particle receiving and discharging system 32 includes an exit chamber 94 communicating with the outlet side of the associated separation chamber 16 at the upper air outlet end 24 thereof. The lighter particle receiving and discharging system 32 also includes an endless foraminous conveyor, generally indicated at 96, similar to the conveyor 38. Here again, the conveyor 96 is shown schematically in FIG. 1 as an endless screen. It is within the contemplation of the present invention that the conveyor 96 be self contained within each device 12 or 14 in a manner similar to conveyor 38. However, it is preferable that the plural conveyor assemblies 96 be integrated into one. As shown, the device 12 includes laterally spaced structures for mounting laterally spaced pairs of spaced sprocket wheels in each device, one pair of spaced sprocket wheels 98 are mounted in the inlet side 18 of the device 12 and one pair of sprocket wheels 100 are mounted in the outlet side 20 of the device 14. Each sprocket wheel 98 and associated sprocket wheel 100 has a link chain 102 trained thereabout and a series of perforated slats 104 are pivotally interconnected, as by piano hinges and extend transversely between the links of the chains 102 so as to define a lower operative flight extending horizontally through the separation chamber 16 and exit chamber 94, of the device 12 and then through the separation chamber 16 and exit chamber 94 of the device 14. The integrated endless foraminous conveyor 96 is driven by a variable speed motor 106 through a suitable motion transmitting mechanism, such as a belt and pulley system 108 connected with a shaft 110 on which both sprocket wheels 100 are fixed. The motor moves the foraminous conveyor 96 in a direction wherein the lower operative flight moves from left to right as shown in FIGS. 1 and 5. The perforations in the conveyor slats 104 are sufficient to allow for the upward flow of air therethrough and sufficiently small to prevent the movement of lighter particles therethrough. The lamina or lighter particles which move upwardly within the separation chamber 16 by the upward air flow therein are received on the operative flight of the foraminous conveyor 96 for movement therewith from the separation chamber 16 into the adjacent exit chamber 94.

A suitable barrier system is provided for enabling the lower operative flight of the foraminous conveyor 96 with attached lamina to move from each separation chamber 16 into the associated communicating exit chamber 94. As shown, the barrier system includes a power-driven paddle wheel type winnower 112 between the separation chamber 16 and the adjacent exit chamber 94 in a position below the operative flight of the foraminous conveyor 96. The paddle wheel winnower 112 is mounted for power-driven rotation about a horizontal transverse axis by a suitable variable speed motor 114 through a suitable motion transmitting mechanism, such as belt and pulley assembly 116. Each paddle wheel winnower 112 is mounted in a position such that its upper periphery is disposed in cooperating relation with the downwardly facing surfaces of the lower operative flight of the endless foraminous conveyor 96. Each paddle wheel winnower is driven by its motor 114 in a direction such that the upper periphery thereof will move at the speed and in the direction of the operative flight so that lighter particles such as lamina which are moved upwardly in the associated separation chamber 16 by the flow of air therein are caused to move upwardly into engagement with the downwardly facing surfaces of the operative flight of the endless foraminous conveyor 96 by virtue of the direct communication of the suction side of the associated fan blade assembly 40 directly above the operative flight and the associated return flight. These lighter particles which are engaged on the downwardly facing surfaces of the operative flight of the conveyor 96 are thus movable with the operative flight past the associated paddle wheel winnower 112, each of which serves to prevent flow of air between the associated separation chamber 16 and exit chamber 94 at a position below the operative flight. Each barrier system may also include upper baffle members 118 and box-like baffle members 120 between the operative flight and the return flight of the conveyor 96 to block the flow of air therebetween.

Finally, it will be noted that a stripping paddle wheel winnower 122 is mounted in the exit chamber 94 of the device 14 adjacent the leading end of the operative flight therein. The exit chamber 94 of the device 14 is completed by an end structure 124. The winnower 122 is power-driven in an opposite direction to that of the associated winnower 112 so as to strip any lamina that might adhere to the downwardly facing surface of the operative flight of the endless foraminous conveyor 96.

It will be noted that, since there is no upward flow of air in any of the exit chambers 94, there is no longer air flow bias maintaining the lamina in engagement with the downwardly facing surfaces of the operative flight of the endless foraminous conveyor 96 as is the case in the separating chambers 16. Consequently, as the lighter particles move into the exit chambers 94, these lighter particles are free to move downwardly by gravity from the operative flight within the associated exit chamber 94. Mounted in the bottom portion of each exit chamber is an endless conveyor 126 which includes an upper horizontally operative run on which the lamina are deposited. Each endless conveyor 126 is powered by a fixed speed motor 128 which serves to move the operative run in a direction to discharge the lamina supported thereon.

The particles received downward within the outlet 36 of the device 12 which includes heavier particles and lighter particles which have not been carried upwardly within the separation chamber 16 and been received and discharged therefrom by the associated lighter particle receiving and discharging system 32 forms the threshed leaf tobacco supply for the device 14 which moves directly downwardly into the inlet 28 thereof for direction into cooperating relation with the projecting winnower assembly 30 thereof.

The arrangement whereby the particles discharging from the outlet 36 of the initial device 12 pass directly into the inlet 28 of the next adjacent device 14 ensures a minimum damage with respect to any lamina or lighter particles which pass with the heavier particles through the outlet 36 of the initial device 12.

It will be seen that the objects of this invention have beer. fully and effectively accomplished. It will be realized that the foregoing preferred specific embodiment has been shown and described for the purpose of this invention and is subject to change without departure from such principles. This invention includes all modifications encompassed within the spirit and scope of the following claims.

What is claimed is:

1. A separation device for separating lighter particles such as lamina containing little or no stem from threshed leaf tobacco which comprises means defining a separation chamber having opposite sides;

means for establishing a generally upward air flow in said separation chamber between the opposite sides thereof;

threshed leaf tobacco projecting means in one side of said chamber for projecting threshed leaf tobacco across the generally upward air flow in said chamber so that (1) lighter particles are carried upwardly by the air flow within said chamber and (2) heavier particles move by gravity downwardly through the air flow within said chamber;

means for receiving the heavier particles moving downwardly through the air flow within said chamber and discharging said heavier particles therefrom; and means for receiving the lighter particles carried upwardly by the air flow within said chamber and discharging said lighter particles therefrom;

said lighter particle receiving and discharging means comprising an exit chamber adjacent the upper portion of said separation chamber;

an endless foraminous conveyor having a lower operative flight extending across the upper portion of said separation chamber and into said exit chamber;

said upward air flow establishing means comprising fan means having a suction side and a pressure side;

means for mounting said fan means so that the pressure side thereof is operable to establish the generally upward air flow within said separation chamber and the suction side thereof is operable to cause air in the upper portion of said separation chamber to move upwardly through the operative flight of said endless foraminous conveyor whereby the lighter particles moving upwardly within said separation chamber are biased thereby to be engaged on downwardly facing surfaces of the operative flight of said endless foraminous conveyor; and means for moving said endless foraminous conveyor in a direction to cause the lighter particles engaged on the downwardly facing surfaces of the operative flight thereof to be moved from said separation chamber into said exit chamber where the engaged lighter particles are no longer biased into conveyor fight engagement by upwardly flowing air and are moved downwardly from conveyor flight engagement for discharge from said exit chamber.

2. A separation device as defined in claim 1 wherein the operative flight of said endless foraminous conveyor has means operatively associated therewith for providing a barrier to the flow of air between said separation and exit chambers;

said barrier providing means comprising a paddle wheel winnower mounted between the separation and exit chambers in a position below the operative flight of said endless foraminous conveyor; and means for rotating said paddle wheel winnower so that an upper periphery thereof moves generally at the speed and in the direction of the operative flight of the endless foraminous conveyor.

3. A separation device as defined in claim 2 wherein said exit chamber is provided with a power operated paddle wheel winnower means operatively associated with the leading end of the portion of the operative flight of the endless foraminous conveyor therein for (1) positively removing particles remaining in engaged relation with the downwardly facing surfaces thereof and (2) moving the same downwardly.

4. A separation device as defined in claim 1 wherein said heavy particle receiving and discharging means includes an endless heavy particle foraminous conveyor within a lower air inlet end of said separation chamber having openings therein of a size to allow the upward air flow to pass upwardly therethrough while preventing heavier particles moving downwardly through said upward air flow from passing downwardly therethrough.

5. A separation device as defined in claim 4, wherein said fan mounting means includes pressure side duct means for communicating the pressure side of said fan means with the lower inlet end of said separation chamber, said pressure side duct means includes an upwardly diverging downstream duct section extending to said heavy particle conveyor and an upstream duct section extending from pressure side of the fan means and connected with said downstream duct section, an upstream portion of said main upstream duct section confining the full pressure side flow of air of said fan means, duct divider wall means within said downstream duct section having a downstream ending at the downstream end of said downstream duct section, said duct divider wall means extending from the downstream ending thereof downwardly within the downstream duct section and into a downstream portion of said main upstream duct section to an upstream ending thereof so as to divide the air flowing thereby into a plurality of separate flow paths, and means immediately upstream of the upstream ending of said duct divider wall means for varying the proportional amount of the full pressure side flow of air in the upstream portion of said main upstream duct section directed into said separate flow paths so as to establish a distribution of air flow upwardly from the downstream duct section which tends to reduce clumping of tobacco particles projected across the upward air flow to thereby facilitate the carrying upward of the lighter particles with the upward air flow and the downward movement of the heavier particles through the upward air flow.

6. A separation device as defined in claim 5, said downstream duct section includes an air flow diffusing member having a multiplicity of air flow openings therein extending across the downstream ending of said downstream duct section in a position below said heavy particle foraminous conveyor.

7. A separation device as defined in claim 6, wherein said duct divider wall means includes two pair of wall portions extending downwardly from the downstream ending thereof and dividing the downstream ending of said downstream duct section into four generally equal separate flow paths, a first pair of said wall portions being generally coplanar and curving from their downward extent generally horizontally into and within the adjacent downstream portion of said main upstream duct section, a second pair of said wall portions being generally coplanar and extending generally vertically within the adjacent downstream portion of said main upstream duct section.

8. A separation device as defined in claim 7, wherein the upstream ending of said two pairs of wall portions is within a horizontal extent of the adjacent downstream portion of said main upstream duct section.

9. A separation device as defined in claim 8, wherein said air flow proportional varying means includes a first vane pivoted at the upstream ending of one of said two pairs of wall portions and a second vane generally perpendicular to said first vane pivoted at the upstream ending of another pair of said two pairs of wall portions, one of said vanes having an angular section removed therefrom to accommodate the pivotal movement of the other vane.

10. A separation device as defined in claim 5 wherein said separation chamber has a tobacco supply inlet at the said one side thereof for receiving a supply of threshed leaf tobacco downwardly therethrough and directing the supply of the threshed leaf tobacco downwardly into cooperating relation with said threshed leaf tobacco projecting means, said means for receiving and discharging the heavier particles further including a heavy particle outlet on the opposite side of said separation chamber for receiving heavy particles downwardly therethrough, said inlet and outlet being positioned and constructed such that said separation device can be mounted in side by side relation to a similar separation device having a similar inlet such that the heavier particles moving downwardly through the outlet of said separation device pass downwardly through the similar inlet of the similar separation device.

11. A separation device as defined in claim 10 wherein said an endless heavy particle foraminous conveyor having an upper operative flight extending from a position generally below said projecting means to a position above said outlet so as to receive thereon heavier particles moving downwardly through said upward air flow and means for moving said heavy particle conveyor in a direction such that heavier particles received on the operative flight thereof will be moved therewith and discharged therefrom downwardly into said outlet.

12. A separation device as claimed in claim 11, wherein said projecting means comprises a power driven rotary projecting winnower having peripheral wall means for maintaining the supply of threshed leaf tobacco moved downwardly from said inlet in cooperating relation with said projecting winnower, said peripheral wall means including a peripheral wall section including a generally tangentially extending discharge end for directing the threshed leaf tobacco from said projecting winnower across the separation chamber, and means for adjusting the angular position of said peripheral wall section with respect to a rotary axis of said projecting winnower to adjust the angular direction the threshed leaf tobacco is projected across the separation chamber by said projecting winnower.

13. A separation device for separating threshed leaf tobacco into (1) lighter particles such as lamina containing little or no stem and (2) heavier particles such as lamina with attached stems or naked stems which comprises:

means defining a separation chamber having horizontally spaced and opposed tobacco inlet and outlet sides and vertically spaced lower air inlet and upper air outlet ends;

means for establishing a generally upward air flow from said lower air inlet end through said separation chamber and outwardly through the upper outlet end thereof;

a tobacco supply inlet at the inlet side of said separation chamber for receiving a supply of threshed leaf tobacco downwardly therethrough;

threshed leaf tobacco projecting means below said tobacco supply inlet for receiving the supply of threshed leaf tobacco moving downwardly through said inlet and for projecting the supply of threshed leaf tobacco across the generally upward air flow within the separation chamber so that (1) the lighter particles are generally carried upwardly by the air flow within the separation chamber and (2) the heavier particles move generally downwardly through the air flow within the separation chamber;

means for receiving and discharging the lighter particles carried upwardly by the air flow within the separation chamber and discharging said lighter particles therefrom;

a heavy particle outlet on the outlet side of said separation chamber for receiving heavy particles downwardly therethrough;

means for directing heavier particles moving downwardly through said upward air flow downwardly into said outlet;

said outlet and inlet being constructed and operatively oriented in complementary downwardly directing and downwardly receiving vertical positions such that said separation device can be mounted in horizontally aligned side-by-side relation to a similar separation device having a similar outlet and inlet similarly constructed and similarly operative oriented such that the heavier particles moving downwardly through the outlet of said separation device are received downwardly through the similar inlet of the similar separation device.

14. A separation device as defined in claim 13 wherein said means for directing heavier particles downwardly into said outlet includes an endless heavy particle foraminous conveyor within the lower air inlet end of said separation chamber having openings therein of a size to allow the upward air flow to pass upwardly therethrough while preventing heavier particles moving downwardly through said upward air flow from passing downwardly therethrough, said heavy particle belt having an upper operative flight extending from a position generally below said projecting means to a position above said outlet so as to receive thereon heavier particles moving downwardly through said upward air flow, means for moving said heavy particle belt in a direction such that heavier particles received on the operative flight thereof will be moved therewith and discharged therefrom downwardly into said outlet.

15. A separation device as defined in claim 14 wherein said upward air flow establishing means including a fan means having a suction side and a pressure side, means for communicating the upper outlet end of said separation chamber with the suction side of said fan means, pressure side duct means for communicating the pressure side of said fan means with the lower inlet end of said separation chamber.

16. A separation device as defined in claim 15 wherein said pressure side duct means includes an upwardly diverging downstream duct section extending to said heavy particle conveyor and an upstream duct section extending from pressure side of the fan means and connected with said downstream duct section, an upstream portion of said main upstream duct section confining the full pressure side flow of air of said fan means, duct divider wall means within said downstream duct section having a downstream ending at the downstream end of said downstream duct section, said duct divider wall means extending from the downstream ending thereof downwardly within the downstream duct section and into a downstream portion of said main upstream duct section to an upstream ending thereof so as to divide the air flowing thereby into a plurality of separate flow paths, and means immediately upstream of the upstream ending of said duct divider wall means for varying the proportional amount of the full pressure side flow of air in the upstream portion of said main upstream duct section directed into said separate flow paths so as to establish a distribution of air flow upwardly from the downstream duct section which tends to reduce clumping of tobacco particles projected across the upward air flow to thereby facilitate the carrying upward of the lighter particles with the upward air flow and the downward movement of the heavier particles through the upward air flow.

17. A separation device as claimed in claim 16 said downstream duct section includes an air flow diffusing member having a multiplicity of air flow openings therein extending across the downstream ending of said downstream duct section in a position below said heavy particle foraminous conveyor.

18. A separation device as claimed in claim 17 wherein said duct divider wall means includes two pair of wall portions extending downwardly from the downstream ending thereof and dividing the downstream ending of said downstream duct section into four generally equal separate flow paths, a first pair of said wall portions being generally coplanar and curving from their downward extent generally horizontally into and within the adjacent downstream portion of said main upstream duct section, a second pair of said wall portions being generally coplanar and extending generally vertically within the adjacent downstream portion of said main upstream duct section.

19. A separation device as claimed in claim 18 wherein the upstream ending of said two pairs of wall portions is within a horizontal extent of the adjacent downstream portion of said main upstream duct section.

20. A separation device as claimed in claim 19 wherein said air flow proportional varying means includes a first vane pivoted at the upstream ending of one of said two pairs of wall portions and a second vane generally perpendicular to said first vane pivoted at the upstream ending of another pair of said two pairs of wall portions, one of said vanes having an angular section removed therefrom to accommodate the pivotal movement of the other vane.

21. A separation device as claimed in claim 13 wherein said projecting means comprises a power driven rotary projecting winnower having peripheral wall means for maintaining the supply of threshed leaf tobacco moved downwardly from said inlet in cooperating relation with said projecting winnower, said peripheral wall means including a peripheral wall section including a generally tangentially extending discharge end for directing the threshed leaf tobacco from said projecting winnower across the separation chamber, and means for adjusting the angular position of said peripheral wall section with respect to a rotary axis of said projecting winnower to adjust the angular direction the threshed leaf tobacco is projected across the separation chamber by said projecting winnower.

22. Apparatus for separating lighter particles such as lamina containing little or no stem from threshed leaf tobacco which comprises means defining a plurality of successive side-by-side separation chambers, each having opposite sides, means for establishing a generally upward air flow in each of said plurality of separation chambers between the opposite sides thereof, threshed leaf tobacco projecting means in one side of each chamber for projecting threshed leaf tobacco across the generally upward air flow in the associated chamber so that (1) lighter particles are carried upwardly by the air flow within the associated chamber and (2) heavier particles move by gravity downwardly through the air flow within the associated chamber, means for receiving the lighter particles carried upwardly by the air flow within each chamber and discharging said lighter particles therefrom, discharge means in the opposite side of each chamber disposed in a position to receive threshed leaf tobacco projected by the associated threshed leaf tobacco projecting means which has not been (1) carried upwardly by the air flow in the associated chamber, as lighter particles received on the associated lighter particle receiving and discharging means or (2) moved downwardly through the air flow in the associated chamber as heavier particles, and means for receiving heavier particles moved downwardly through the air flow in each chamber and moving the received heavier particles into received relation with respect to the associated discharge means, said plurality of side-by-side separation chambers including an initial end chamber having means for directing a supply of threshed leaf tobacco to the threshed leaf tobacco projecting means thereof and a final end chamber, the discharge means of each chamber except said final end chamber being operable to direct the threshed leaf tobacco and heavier particles received therein directly to the threshed leaf tobacco projecting means of an adjacent chamber.

23. An apparatus as defined in claim 22 wherein each of said separation chambers is of similar construction.

24. An apparatus as defined in claim 23 wherein the lighter particle receiving and discharging means comprises an exit chamber adjacent the upper portion of each separation chamber, endless foraminous conveyor means having lower operative flight means extending across the upper portion of each separation chamber and into the associated exit chamber, the upward air flow establishing means of each separation chamber comprising fan means having a suction side and a pressure side, means for mounting each fan means so that the pressure side thereof is operable to establish the generally upward air flow within the associated separation chamber and the suction side thereof is operable to cause air in the upper portion of the associated separation chamber to move upwardly through the lower operative flight means of the associated endless foraminous conveyor means whereby the lighter particles moving upwardly within each separation chamber are biased thereby to be engaged on downwardly facing surface means of the lower operative flight means of the endless foraminous conveyor means, and means for moving said endless foraminous conveyor means in a direction to cause the lighter particles engaged on the downwardly facing surface means of the lower operative flight means thereof to be moved from each separation chamber into the associated exit chamber where the engaged lighter particles are no longer biased into conveyor fight means engagement by upwardly flowing air and are moved downwardly from conveyor flight means engagement for discharge from the associated exit chamber.

25. An apparatus as defined in claim 24 wherein the operative flight means extends horizontally at generally one vertical level within each separation chamber and associated exit chamber.

26. An apparatus as defined in claim 25 wherein said endless foraminous conveyor means includes a single endless foraminous conveyor.

27. An apparatus as defined in claim 24 wherein at least one exit chamber is provided with power-operated paddle wheel winnower means operatively associated with a leading end of the portion of the operative flight means therein of the endless foraminous conveyor means for (1) positively removing particles remaining in engaged relation with the downwardly facing surface means thereof, and (2) moving the engaged particles downwardly.

28. An apparatus as defined in claim 27 wherein the lighter particle receiving and discharging means further includes conveyor means mounted in the lower portion of each exit chamber for receiving the lighter particles moving downwardly from said conveyor flight means engagement and discharging the same outwardly of the associated exit chamber.

29. An apparatus as defined in claim 24 wherein each of said heaving particle receiving and discharging means includes an endless heavy particle foraminous conveyor within a lower air inlet end of the associated separation chamber having openings therein of a size to allow the upward air flow to pass upwardly therethrough while preventing heavier particles moving downwardly through said upward air flow from passing downwardly therethrough.

30. An apparatus as defined in claim 29 wherein each of said fan mounting means includes pressure side duct means for communicating the pressure side of the associated fan means with the lower inlet end of the associated separation chamber, each of said pressure side duct means includes an upwardly diverging outlet duct section extending to the associated heavy particle conveyor and an upstream duct section extending from pressure side of the associated fan means and connected with said downstream duct section, an upstream portion of each of said main upstream duct sections confining the full pressure side flow of air of the associated fan means, duct divider wall means within each downstream duct section having a downstream ending at the downstream end of the associated downstream duct section, each of said duct divider wall means extending from the downstream ending thereof downwardly within the associated downstream duct section and into a downstream portion of the associated main upstream duct section to an upstream ending thereof so as to divide the air flowing thereby into a plurality of separate blow paths, and means immediately upstream of the upstream ending of each of said duct divider wall means for varying the proportional amount of the full pressure side flow of air in the upstream portion of the associated main upstream duct section directed into said separate flow paths so as to establish a distribution of air flow upwardly from the associated downstream duct section which tends to reduce clumping of tobacco particles projected across the upward air flow to thereby facilitate the carrying upward of the lighter particles with the upward air flow and the downward movement of the heavier particles through the upward air flow.

31. An apparatus as claimed in claim 30 wherein each of said downstream duct sections includes an air flow diffusing member having a multiplicity of air flow openings therein extending across the downstream ending of the associated downstream duct section in a position below the associated heavy particle foraminous conveyor.

32. An apparatus as claimed in claim 31 wherein each of said duct divider wall means includes two pair of wall portions extending downwardly from the downstream ending thereof and dividing the downstream ending of the associated downstream duct section into four generally equal separate flow paths, a first pair of said wall portions being generally coplanar and curving from their downward extent generally horizontally into and within the adjacent downstream portion of the associated main upstream duct section, a second pair of said wall portions being generally coplanar and extending generally vertically within the adjacent downstream portion of the associated main upstream duct section.

33. An apparatus as claimed in claim 32 wherein the upstream ending of said two pairs of wall portions is within a horizontal extent of the adjacent downstream portion of the associated main upstream duct section.

34. An apparatus as claimed in claim 33 wherein each of said air flow proportional varying means includes a first vane pivoted at the upstream ending of one of the associated two pairs of wall portions and a second vane generally perpendicular to said first vane pivoted at the upstream ending of another pair of the associated two pairs of wall portions, one of said vanes having an angular section removed therefrom to accommodate the pivotal movement of the other vane.

35. An apparatus as claimed in claim 24 wherein each of said projecting means comprises a power driven rotary projecting winnower having peripheral wall means for maintaining the supply of threshed leaf tobacco moved downwardly from said inlet in cooperating relation with said projecting winnower, said peripheral wall means including a peripheral wall section including a generally tangentially extending discharge end for directing the threshed leaf tobacco from said projecting winnower across the separation chamber, and means for adjusting the angular position of said peripheral wall section with respect to a rotary axis of said projecting winnower to adjust the angular direction the threshed leaf tobacco is projected across the separation chamber by said projecting winnower.

36. A separation device for separating threshed leaf tobacco into (1) lighter particles such as lamina containing little or no stem and (2) heavier particles such as lamina with attached stems or naked stems which comprises:

means defining a separation chamber having horizontally spaced and opposed tobacco inlet and outlet sides and vertically spaced lower air inlet and upper air outlet ends;

means for establishing a generally upward air flow from said lower air inlet end through said separation chamber and outwardly through the upper outlet end thereof;

threshed leaf tobacco projecting means for receiving the supply of threshed leaf tobacco moving downwardly through said inlet and for projecting the supply of threshed leaf tobacco across the generally upward air flow within the separation chamber so that (1) the lighter particles are generally carried upwardly by the air flow within the separation chamber and (2) the heavier particles move generally downwardly through the air flow within the separation chamber;

means for receiving and discharging the lighter particles carried upwardly by the air flow within the separation chamber and discharging said lighter particles therefrom;

an endless heavy particle discharging foraminous conveyor within the lower air inlet end of said separation chamber having openings therein of a size to allow the upward air flow to pass upwardly therethrough while preventing heavier particles moving downwardly through said upward air flow from passing downwardly therethrough;

said upward air flow establishing means including fan means having a suction side and a pressure side;

means for communicating the upper outlet end of said separation chamber with the suction side of said fan means;

pressure side duct means for communicating the pressure side of said fan means with the lower inlet end of said separation chamber;

said pressure side duct means including an upwardly diverging downstream duct section extending to said heavy particle conveyor and an upstream duct section extending from the pressure side of the fan means and connected with said downstream duct section;

an upstream portion of said main upstream duct section confining the full pressure side flow of air of said fan means, duct divider wall means within said downstream duct section having a downstream ending at the downstream end of said downstream duct section, said duct divider wall means extending from the downstream ending thereof downwardly within the downstream duct section and into a downstream portion of said main upstream duct section to an upstream ending thereof so as to divide the air flowing thereby into a plurality of separate flow paths;

and means immediately upstream of the upstream ending of said duct divider wall means for varying the proportional amount of the full pressure side flow of air in the upstream portion of said main upstream duct section directed into said separate flow paths so as to establish a distribution of air flow upwardly from the downstream duct section which tends to reduce clumping of tobacco particles projected across the upward air flow to thereby facilitate the carrying upward of the lighter particles with the upward air flow and the downward movement of the heavier particles through the upward air flow.

37. A separation device as defined in claim 36 wherein said downstream duct section includes an air flow diffusing member having a multiplicity of air flow openings therein extending across the downstream ending of said downstream duct section in a position below said heavy particle foraminous conveyor.

38. A separation device as defined in claim 37 wherein said duct divider wall means includes two pair of wall portions extending downwardly from the downstream ending thereof and dividing the downstream ending of said downstream duct section into four generally equal separate flow paths, a first pair of said wall portions being generally coplanar and curving from their downward extent generally horizontally into and within the adjacent downstream portion of said main upstream duct section, a second pair of said wall portions being generally coplanar and extending generally vertically within the adjacent downstream portion of said main upstream duct section.

39. A separation device as defined in claim 38 wherein the upstream ending of said two pairs of wall portions is within a horizontal extent of the adjacent downstream portion of said main upstream duct section.

40. A separation device as defined in claim 39 wherein said air flow proportional varying means includes a first vane pivoted at the upstream ending of one of said two pairs of wall portions and a second vane generally perpendicular to said first vane pivoted at the upstream ending of another pair of said two pairs of wall portions, one of said vanes having an angular section removed therefrom to accommodate the pivotal movement of the other vane.

41. Apparatus for separating lighter particles such as lamina containing little or no stem from threshed leaf tobacco which comprises means defining a plurality of successive side-by-side separation chambers, each having a pair of opposite sides one of which is a projecting side and one of which is a receiving side, means for establishing a generally upward air flow in each of said plurality of separation chambers between the opposite sides thereof, threshed leaf tobacco projecting means in the projecting side of each chamber for projecting threshed leaf tobacco across the generally upward air flow in the associated chamber so that lighter particles are carried upwardly by the air flow within the chamber, means for receiving the lighter particles carried upwardly by the air flow within each chamber and discharging said lighter particles therefrom, said plurality of side-by-side separation chambers including an initial end chamber having means for directing a supply of threshed leaf tobacco to the threshed leaf tobacco projecting means in the projecting side thereof and a final end chamber, said side-by-side separation chambers being adjacent to one another so that each chamber other than said final end chamber has the receiving side thereof provided with means for (1) receiving tobacco particles projected toward the same by the projecting means in the opposite projecting side thereof and (2) delivering the received tobacco particles to the projecting means in the adjacent projecting side of the adjacent chamber, and means for discharging from said chambers the tobacco particles in the threshed leaf tobacco supply directed to the threshed leaf tobacco projecting means of said initial end chamber other than the lighter particles carried upwardly by the air flow within each chamber which are received and discharged by said lighter particles receiving and discharging means.

42. Apparatus as defined in claim 41 wherein each chamber other than said final end chamber includes an endless heavy particle foraminous conveyor in the lower portion thereof through which the upward air flow of the associated chamber passes (1) for receiving heavier particles in the associated chamber thereabove which move by gravity downwardly through the upward air flow and (2) for directing the received heavier particles to the projecting means in the projecting side of the adjacent chamber.

* * * * *